US007722040B2

(12) United States Patent
Matsushima

(10) Patent No.: US 7,722,040 B2
(45) Date of Patent: May 25, 2010

(54) SHEET CARRYING DEVICE AND SHEET CARRYING METHOD FOR IMAGE FORMING APPARATUS

(75) Inventor: Toshihiro Matsushima, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/203,095

(22) Filed: Sep. 2, 2008

(65) Prior Publication Data

US 2009/0057996 A1 Mar. 5, 2009

Related U.S. Application Data

(60) Provisional application No. 60/969,593, filed on Aug. 31, 2007.

(51) Int. Cl.
*B65H 5/02* (2006.01)

(52) U.S. Cl. ..... 271/273; 271/272

(58) Field of Classification Search ..... 271/272, 271/273

See application file for complete search history.

(56) References Cited

U.S. PATENT DOCUMENTS

| | | | | |
|---|---|---|---|---|
| 4,848,765 | A * | 7/1989 | Torii | 271/274 |
| 4,986,527 | A * | 1/1991 | Ogoda | 271/250 |
| 6,139,011 | A * | 10/2000 | Huang et al. | 271/274 |
| 2007/0228647 | A1 * | 10/2007 | Hara | 271/272 |

* cited by examiner

*Primary Examiner*—Kaitlin S Joerger
(74) *Attorney, Agent, or Firm*—Patterson & Sheridan, LLP

(57) ABSTRACT

In an embodiment of the invention, a cam of a pitch adjustment mechanism can be slid and moved along a first shaft. When a sheet is a standard paper, the pitch adjustment mechanism is ejected from an adjustment position by an urging force of a movement spring and is moved to a standby position, and slide contact between the cam and a second shaft is released. When a sheet is a thick paper, a solenoid is turned on, the pitch adjustment mechanism is disposed at the adjustment position by a plunger, and it is prevented that the registration roller pair abruptly come in contact with each other after the thick paper passes through.

13 Claims, 6 Drawing Sheets

SHEET CARRYING DEVICE AND SHEET CARRYING METHOD FOR IMAGE FORMING APPARATUS

CROSS-REFERENCE TO RELATED APPLICATION

This application is based upon and claims the benefit of priority from U.S. Provisional Application 60/969,593 filed on Aug. 31, 2007, the entire contents of which are incorporated herein by reference.

BACKGROUND

The present invention relates to a sheet carrying device for an image forming apparatus, which stably carries a recording medium without causing image blur in a copier, a printer or the like.

In an image forming apparatus such as a copier or a printer, when image formation is performed by using a thick paper having a large weighing capacity, image blur is liable to occur. In general, when the trailing edge of a thick paper passes through a registration roller pair, it is flipped by the registration rollers and the thick paper is instantaneously accelerated. As a result, the thick paper deforms, for example, a transfer belt by its firmness, and the image blur is caused. This is caused because, when the trailing edge of the thick paper passes through the registration rollers, the registration roller pair abruptly returns to the contact state.

Thus, hitherto, a delay mechanism is provided in the registration roller pair, and when the trailing edge of the thick paper passes through, the return of the registration roller pair to the contact state is delayed. This adjustment mechanism is such that a cam is axially attached to one of the registration rollers, and the cam is made to intervene between the shafts of the registration roller pair. By the operation of this cam, when the trailing edge of the sheet passes through, the return of the registration roller pair to the contact state is delayed. That is, after the trailing edge of the sheet passes through the cam, the cam is rotated together with the shaft of the other registration roller, and the registration roller pair slowly returns to the contact state. By this, it is suppressed that the thick paper is accelerated, and the image blur at the time of image formation is prevented.

However, in the conventional adjustment mechanism, even at the time of image formation on a standard paper, the shaft of the registration roller for rotating the cam together is always in contact with a specific position of the cam. Accordingly, the specific position of the cam made of, for example, POM (polyacetal) is worn away by the shaft made of, for example, metal. When the specific portion of the cam is worn away as stated above, the original operation of the cam cannot be obtained, and the cam cannot smoothly rotate during the passage of the thick paper, and besides, after the thick paper passes through, it becomes impossible to smoothly return the registration roller pair to the contact state. Thus, there is a fear that the exchange frequency of the cam increases, and the maintenance property is degraded.

Then, it is desired to develop a sheet carrying device for an image forming apparatus, which prevents a cam of an adjustment mechanism from being worn away, prolongs the life of the cam, and is excellent in maintenance property.

SUMMARY

An aspect of the invention is to prevent wear of a cam caused by a shaft of a registration roller at the time of image formation on a standard paper, to prolong the life of the cam, and to improve the maintenance property.

According to an embodiment of the invention, a sheet carrying device for an image forming apparatus includes a registration roller pair to carry a recording medium to a transfer position of an image carrier, a contact delay mechanism to set a pitch between the registration roller pair in accordance with a thickness of the recording medium passing through the registration roller pair and to hold the pitch when the recording medium passes through the registration roller pair, and a movement member to dispose the contact delay mechanism at an adjustment position at a time of carrying a thick paper recording medium and to eject the contact delay mechanism from the adjustment position at a time of carrying a standard paper recording medium.

DETAILED DESCRIPTION

Figure 1:
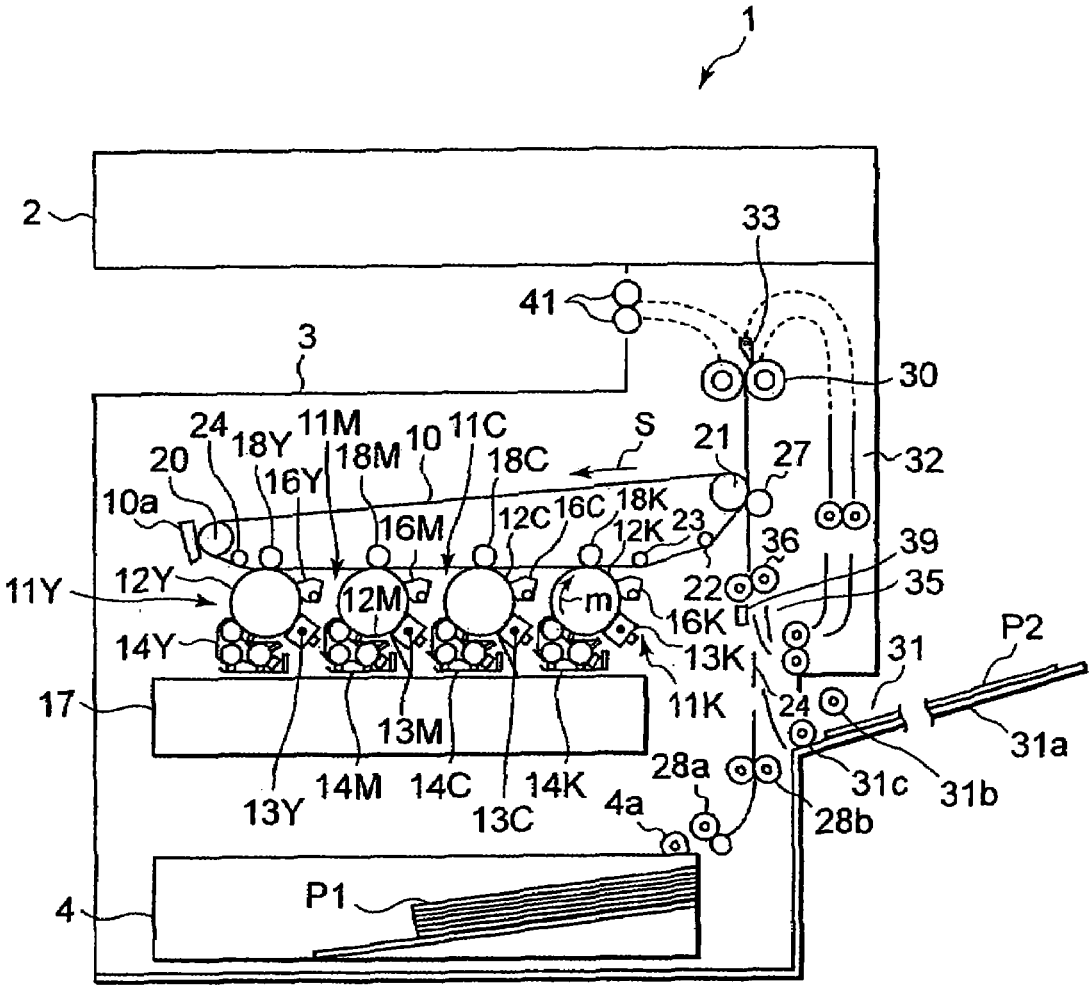
FIG. 1 is a schematic structural view showing a color copier of an embodiment of the invention.

Hereinafter, an embodiment of the invention will be described in detail with reference to the accompanying drawings. FIG. 1 is a schematic structural view showing a four-tandem color copier 1 as an image forming apparatus of the embodiment of the invention. The color copier 1 includes a scanner unit 2 and an in-body paper discharge unit 3 which are disposed on an upper side. The color copier 1 includes an image forming unit 11 having four sets of image forming stations 11Y, 11M, 11C and 11K of yellow (Y), magenta (M), cyan (C) and black (K) disposed in parallel along the lower side of an intermediate transfer belt 10.

The respective image forming stations 11Y, 11M, 11C and 11K include photoconductive drums 12Y, 12M, 12C and 12K, respectively. Charging chargers 13Y, 13M, 13C and 13K, developing devices 14Y, 14M, 14C and 14K, and photoreceptor cleaning devices 16Y, 16M, 16C and 16K are disposed respectively around the photoconductive drums 12Y, 12M, 12C and 12K along rotation directions of arrow m directions. Exposure lights are irradiated by a laser exposure device 17 between the charging chargers 13Y, 13M, 13C and 13K and the developing devices 14Y, 14M, 14C and 14K around the photoconductive drums 12Y, 12M, 12C and 12K, and electrostatic latent images are formed on the photoconductive drums 12Y, 12M, 12C and 12K.

The developing devices 14Y, 14M, 14C and 14K respectively have two-component developers made of toners of yellow (Y), magenta (M), cyan (C) and black (K) and carriers.

An intermediate transfer belt 10 as an image carrier is stretched by a backup roller 21, a driven roller 20, and the first to the third tension rollers 22 to 24. The intermediate transfer belt 10 is opposite to and in contact with the photoconductive drums 12Y, 12M, 12C and 12K. Primary transfer rollers 18Y, 18M, 18C and 18K for primarily transferring toner images on the photoconductive drums 12Y, 12M, 12C and 12K to the intermediate transfer belt 10 are provided at positions of the intermediate transfer belt 10 opposite to the photoconductive drums 12Y, 12M, 12C and 12K.

A secondary transfer roller 27 is disposed in a secondary transfer unit at a transfer position of the intermediate transfer belt 10 supported by the backup roller 21. In the secondary transfer unit, a specified secondary transfer bias is applied to the backup roller 21. When a sheet paper as a recording medium passes through between intermediate transfer belt 10 and the secondary transfer roller 27, the toner images on the intermediate transfer belt 10 are secondarily transferred onto the sheet paper. After the secondary transfer is ended, the intermediate transfer belt 10 is cleaned by a belt cleaner 10*a*.

A paper feed cassette 4 for feeding sheet papers in a direction toward the secondary transfer roller 27 is provided below the laser exposure device 17. A manual feed mechanism 31 for manually feeding sheet papers is provided on the right side of the color copier 1.

A pickup roller 4*a*, a separation roller 28*a*, a carrying roller 28*a* and a registration roller pair 36 are provided between the paper feed cassette 4 and the secondary transfer roller 27. A manual feed pickup roller 31*b* and a manual feed separation roller 31*c* are provided between a manual feed tray 31*a* of the manual feed mechanism 31 and the registration roller pair 36.

Further, a medium sensor 39 for detecting the kind of sheet paper is disposed on a vertical carrying path 34 for carrying the sheet paper in the direction toward the secondary transfer roller 27 from the paper feed cassette 4 or the manual feed tray 31*a*. The medium sensor 39 detects the thickness of various sheet papers by using, for example, a contact-type detection terminal. The color copier 1 can control the carrying speed of sheet paper, a transfer condition, a fixing condition and the like from the detection result of the medium sensor 39. Besides, a fixing device 30 is provided downstream of the secondary transfer unit along the direction of the vertical carrying path 34.

The sheet paper taken out from the paper feed cassette 4 or fed from the manual feed mechanism 31 is carried along the vertical carrying path 34 through the registration roller pair 36 and the secondary transfer roller 27 to the fixing device 30. The fixing device 30 fixes the toner image transferred on the sheet paper by a heat treatment in the secondary transfer unit. A gate 33 is provided downstream of the fixing device 30, and changes over the direction toward a paper discharge roller 41 and the direction toward a re-carrying unit 32. The sheet paper guided to the paper discharge roller 41 is discharged to the in-body paper discharge unit 3. Besides, the sheet paper guided to the re-carrying unit 32 is again guided in the direction toward the secondary transfer roller 27.

The image forming station 11Y integrally includes the photoconductive drum 12Y and process means, and is provided to be attachable to and detachable from the image forming apparatus body. The process means represents at least one of the charging charger 13Y, the developing device 14Y and the photoreceptor cleaning device 16Y. The image forming stations 11M, 11C and 11K have the same structure as the image forming station 11Y, and each of the image forming stations 11Y, 11M, 11C and 11K may be attachable to and detachable from the image forming apparatus, or they may be attachable to and detachable from the image forming apparatus as an integral image forming unit 11.

Figure 2:
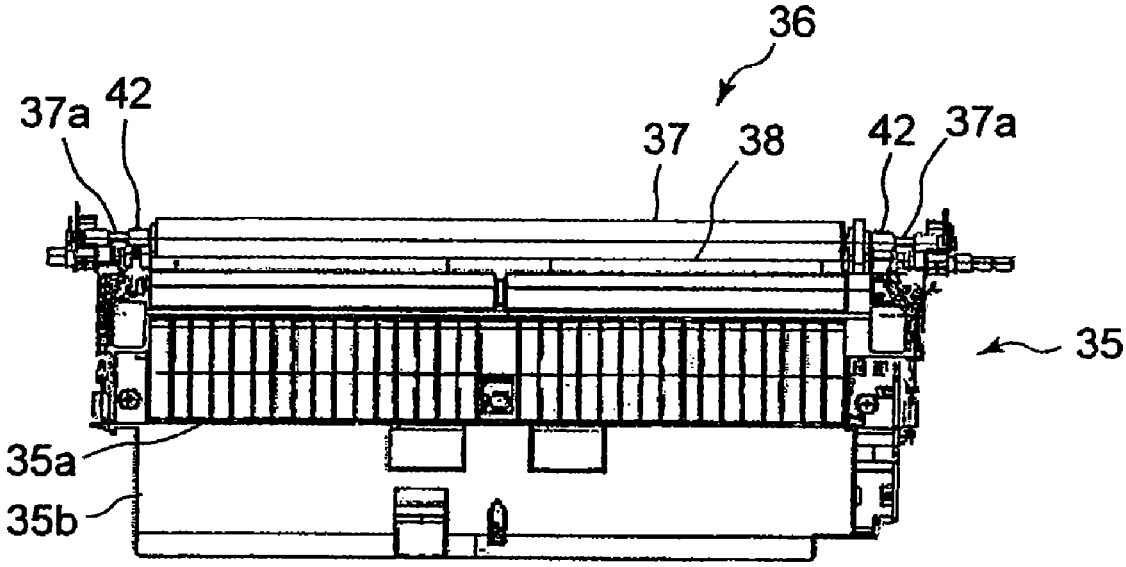
FIG. 2 is a schematic side view showing a registration roller unit of the embodiment of the invention.
Figure 3:
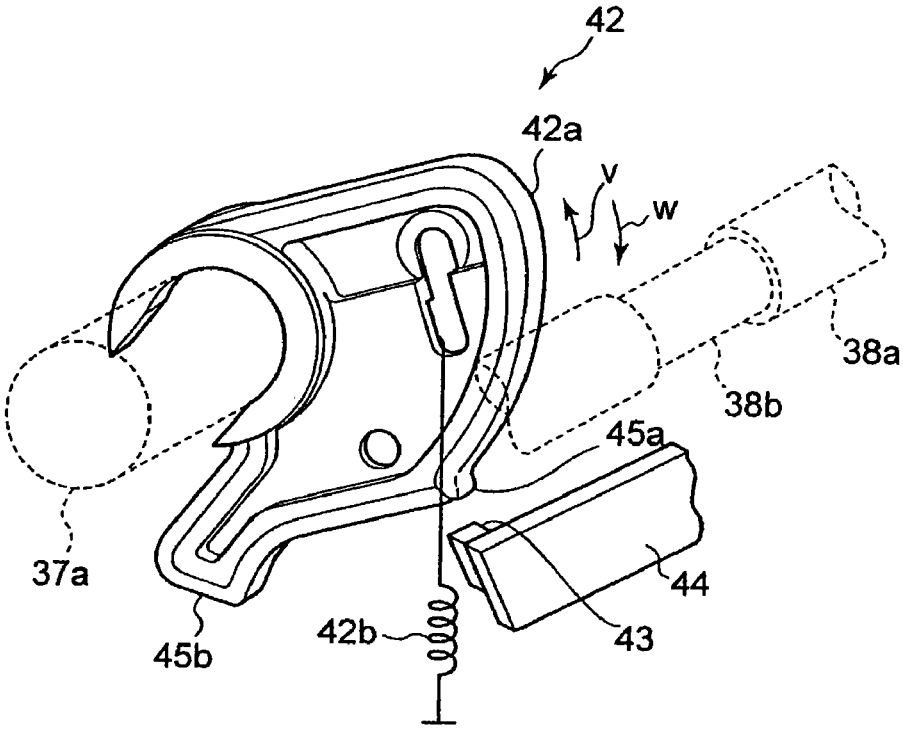
FIG. 3 is a schematic perspective view showing a pitch adjustment mechanism of the embodiment of the invention.
Figure 4:
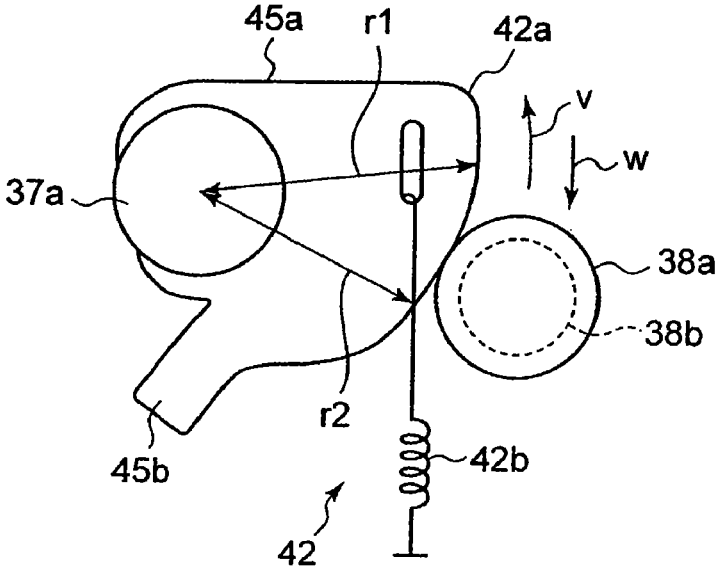
FIG. 4 is a schematic side view showing the pitch adjustment mechanism of the embodiment of the invention.

Next, the registration roller pair 36 will be described in detail with reference to a registration roller unit 35 of FIG. 2. Reference numerals 35*a* and 35*b* denote carrying guides of sheet paper. The registration roller pair 36 includes a first roller 37 and a second roller 38. A pitch adjustment mechanism 42 as a contact delay mechanism shown in FIG. 3 is provided at the front side and the rear side of a first shaft 37*a* of the first roller 37. The pitch adjustment mechanism 42 includes a cam 42*a* axially attached to the first shaft 37*a*. As shown in FIG.4 the cam 42*a* is formed such that a distance (r) between the first shaft 37*a* and the outer periphery of the cam 42*a* becomes (r1)>(r2). Besides, the pitch adjustment mechanism 42 has a cam spring 42*b* as a first urging member for urging the cam 42*a* in an arrow w direction.

While the pitch adjustment mechanism 42 is disposed at an adjustment position, the posture of the cam 42*a* is controlled by the pitch between the first shaft 37*a* and a second shaft 38*a* and the cam spring 42*b*. Besides, while the pitch adjustment mechanism 42 is disposed at the adjustment position, the cam 42*a* is in slide contact with the second shaft 38*a* of the second roller 38. The cam 42*a* is rotated together with the second shaft 38*a* by the rotation of the second shaft 38*a*, and can be rotated in an arrow v direction.

Further, the pitch adjustment mechanism 42 has a stopper 43 for regulating the rotation range of the cam 42*a*. The stopper 43 is provided at an end of a registration front guide 44 for guiding the sheet paper to the registration roller pair 36. The stopper 43 comes in contact with a regulation lever 45*b*, and regulates the rotation range of the cam 42*a* in the arrow v direction by the second shaft 38*a*. Besides, the stopper 43 comes in contact with a lower corner part 45*a* of the cam 42*a* and regulates the rotation range of the cam 42*a*in an arrow w direction by the cam spring 42*b*.

The cam 42*a* is rotated in the arrow w direction by the cam spring 42*b* according to the thickness of the sheet paper as the recording medium during the passage through the registration roller pair 36. After the sheet paper passes through the registration roller pair 36, the cam 42*a* is rotated in the arrow v direction by the second shaft 38*a*.

The urging force of the cam spring 42*b* for rotating the cam 42*a* in the arrow w direction varies according to the arrangement position of the cam 42*a*. That is, the urging force of the cam 42*a* when the cam 42*a* is disposed at the adjustment position described later is larger than the urging force of the cam 42*a* when the cam 42*a* is ejected from the adjustment position.

A movement spring 47 as a second urging member and a plunger 48*a* of a solenoid 48, which constitute a movement member, are attached to the cam 42*a*. The other end of the movement spring 47 and the solenoid 48 are attached to a unit frame. The movement spring 47 urges the cam 42*a* at the front side in an arrow x1 direction, urges the cam 42*a* at the rear side in an arrow x2 direction, slides the cam 42*a* along the first shaft 37*a*, and can eject the cam 42*a* from the adjustment position to a standby position. An opposite part 38*b* to the standby position is formed to be cut out so that, when the cam 42*a* is ejected to the standby position, the second shaft 38*a* does not come in slide contact with the cam 42*a*.

The solenoid 48 extends the plunger 48*a* at the front side in an arrow y1 direction at the time of power application, extends the plunger 48*a* at the rear side in an arrow y2 direction at the time of power application, and holds the cam 42*a* at the adjustment position. The cam 42*a* is in slide contact with the second shaft 38*a* while it is held at the adjustment position.

Figure 5:
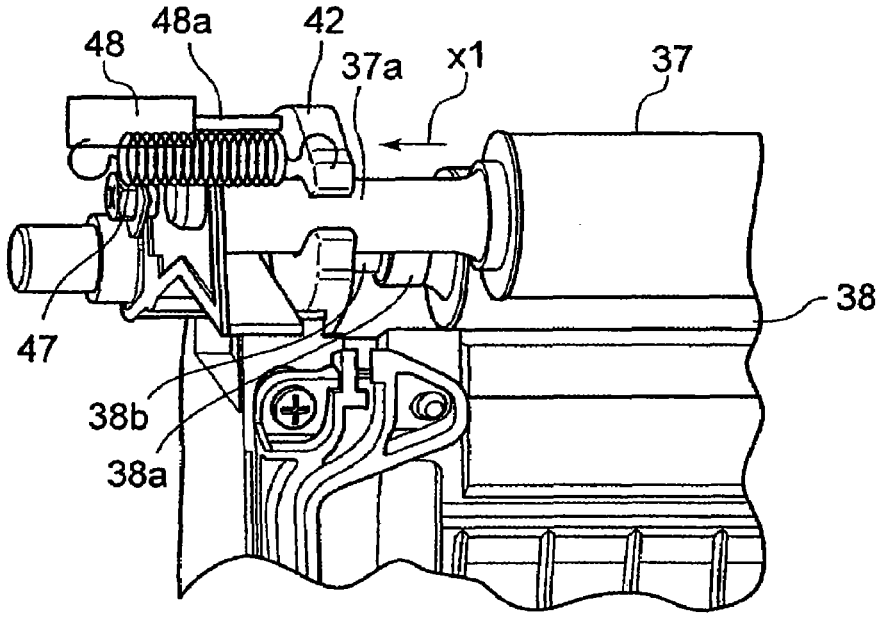
FIG. 5 is a front side partial explanatory view showing a state where the pitch adjustment mechanism of the embodiment of the invention is ejected from an adjustment position.
Figure 6:
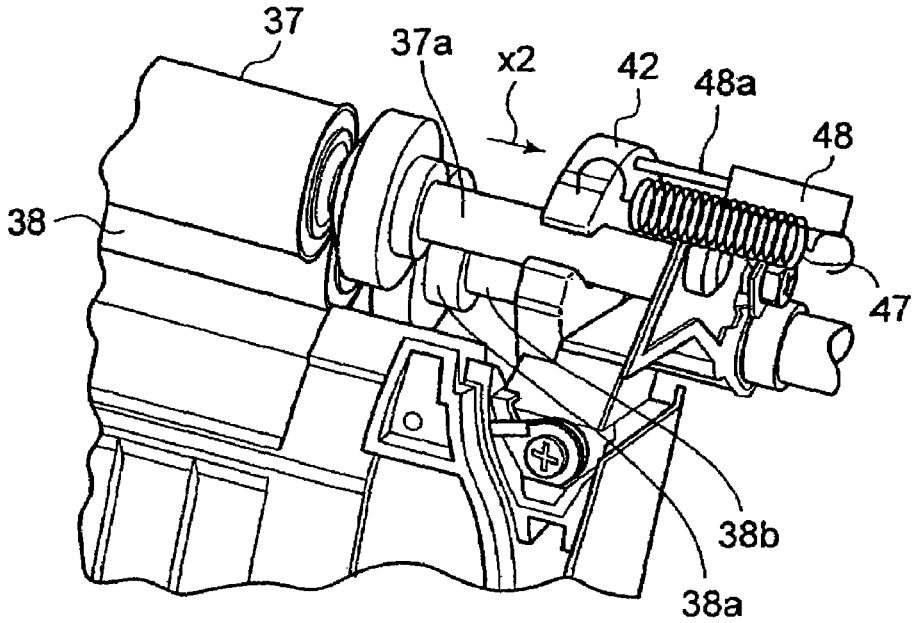
FIG. 6 is a rear side partial explanatory view showing a state where the pitch adjustment mechanism of the embodiment of the invention is ejected from the adjustment position.

Next, the operation of the pitch adjustment mechanism 42 will be described. When the power source of the color copier 1 is off, in the registration roller unit 35, the first roller 37 and the second roller 38 of the registration roller pair 36 are separate from each other. Besides, when the power source of the color copier 1 is off, since the solenoid 48 is off, the cam 42*a* is pulled in the arrow x direction by the urging force of the movement spring 47, and is ejected from the adjustment position to the standby position as shown in FIG. 5 and FIG. 6. That is, the cam 42*a* is separate from the second shaft 38*a*. Also during this, the urging force to cause rotation in the arrow w direction is given to the cam 42*a* by the cam spring 42*b*. However, since the regulation lever 45*b* comes in contact with the stopper 43, the rotation range of the cam 42*a* is regulated.

Figure 7:
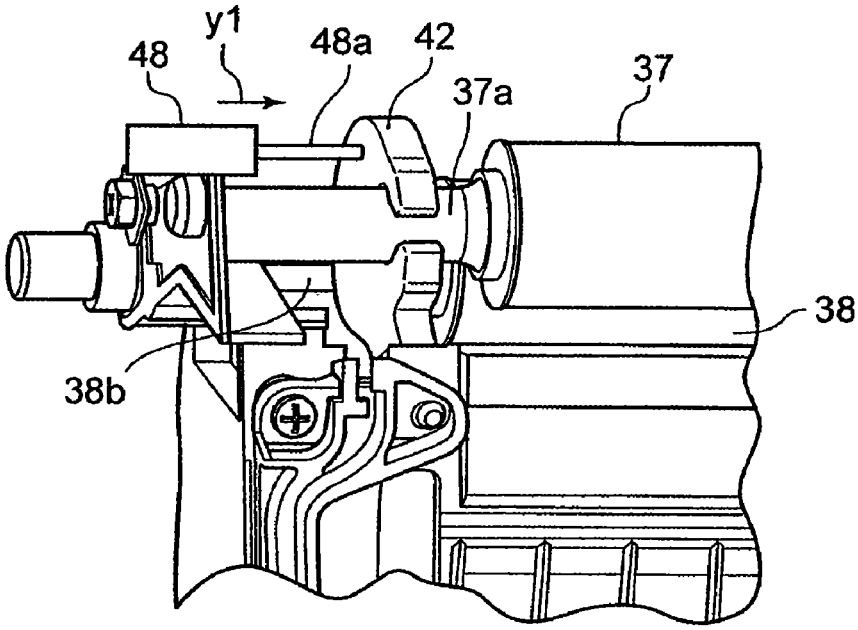
FIG. 7 is a front side partial explanatory view showing a state where the pitch adjustment mechanism of the embodiment of the invention is disposed at the adjustment position.
Figure 8:
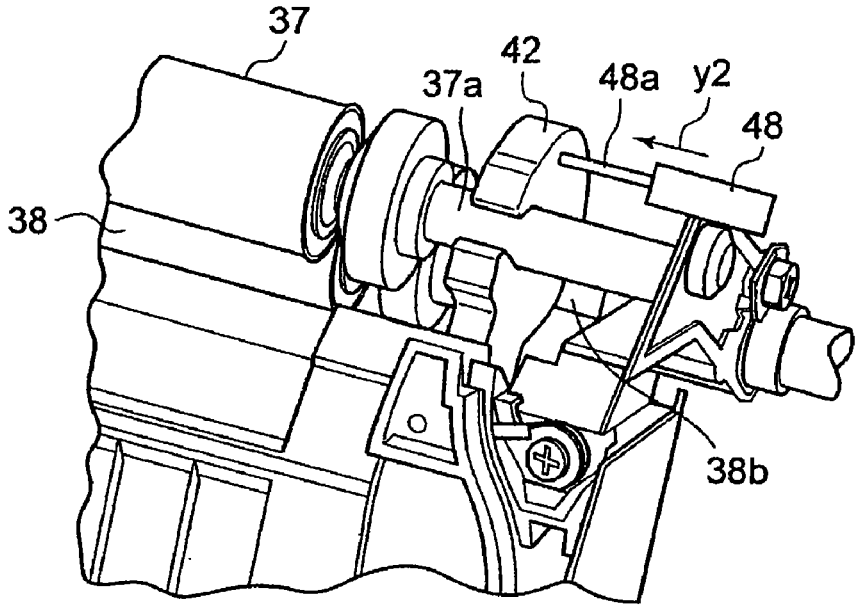
FIG. 8 is a rear side partial explanatory view showing a state where the pitch adjustment mechanism of the embodiment of the invention is disposed at the adjustment position.

When the power source is turned on in such a state, first, the solenoid 48 is turned on, and the plunger 48*a* is extended. By this, the cam 42*a* is slid in an arrow yl direction at the front side and is slid in an arrow y2 direction at the rear side along the first shaft 37*a* against the urging force of the movement spring 47, and is set in the initial state where it is disposed at the adjustment position as shown in FIG. 7 and FIG. 8. By this, the cam 42*a* is brought into slide contact with the first shaft 37*a*.

Next, the rotation of the registration roller pair 36 is started, and when the second shaft 38*a* is rotated, the cam 42*a* is rotated together with the second shaft 38*a*, and is rotated in the arrow v direction. Accordingly, the pitch between the first shaft 37*a* and the second shaft 38*a* regulated by the cam 42*a* is reduced. By this, the first roller 37 and the second roller 38 are brought into contact with each other by the urging force to urge both the rollers 37 and 38 in the contact direction. Incidentally, when the corner part 45*a* of the cam comes in contact with the stopper 43, the rotation of the cam 42*a* in the arrow v direction is regulated irrespective of the rotation together with the second shaft 38*a*.

Thereafter, when the color copier 1 is placed in a ready state, the solenoid 48 is turned off. By this, the cam 42*a* is pulled in the arrow x1 direction at the front side and is pulled in the arrow x2 direction at the rear side, by the urging force of the movement spring 47, and is ejected from the adjustment position to the standby position as shown in FIG. 5 and FIG. 6. By this, the cam 42*a* is separated from the second shaft 38*a*.

Next, in the color copier 1, an image formation process onto a standard paper P1 as a standard paper recording medium having a weighing capacity of, for example, about 64 to 80 g/m$^2$ is started. At this time, the pitch adjustment mechanism 42 does not perform any operation on the registration roller pair 36. By the start of the image formation process, in the image forming unit 11, toner images are formed on the photoconductive drums 12Y, 12M, 12C and 12K in the image forming stations 11Y, 11M, 11C and 11K. The toner images on the respective photoconductive drums 12Y, 12M, 12C and 12K are multiply transferred onto the intermediate transfer belt 10 in sequence, and a full-color toner image is formed on the intermediate transfer belt 10 and reaches the secondary transfer roller 27.

At this time, synchronously with the full-color toner image on the intermediate transfer belt 10, the standard paper P1 is carried to between the intermediate transfer belt 10 and the secondary transfer roller 27. For example, the standard paper P1 is taken out from the paper feed cassette 4 by the pickup roller 4*a*, and is fed to the registration roller pair 36 through the separation roller 28*a* and the carrying roller 28*b*. After the leading edge of the standard paper P1 is aligned, the registration roller pair 36 starts to rotate, and feeds the standard paper P1 to the secondary transfer unit. Thereafter, the toner image on the intermediate transfer belt 10 is transferred to the standard paper P1 in the secondary transfer unit, and is heated, pressed and fixed by the fixing device 30, and the fixed toner image is completed. After the fixing, when a single-sided image is formed, the standard paper P1 is directly discharged to the in-body paper discharge unit 3 by the discharge roller 41 through the gate 33. When both-sided image or multiple printing is performed, the standard paper is re-carried to the secondary transfer unit through the re-carrying unit 32.

As stated above, while the standard paper P1 is being fed, the cam 42*a* of the registration roller pair 36 is set at the standby position and is separate from the second shaft 38*a*, and therefore, the cam is not worn away by the slide contact with the second shaft 38*a*.

Figure 9:
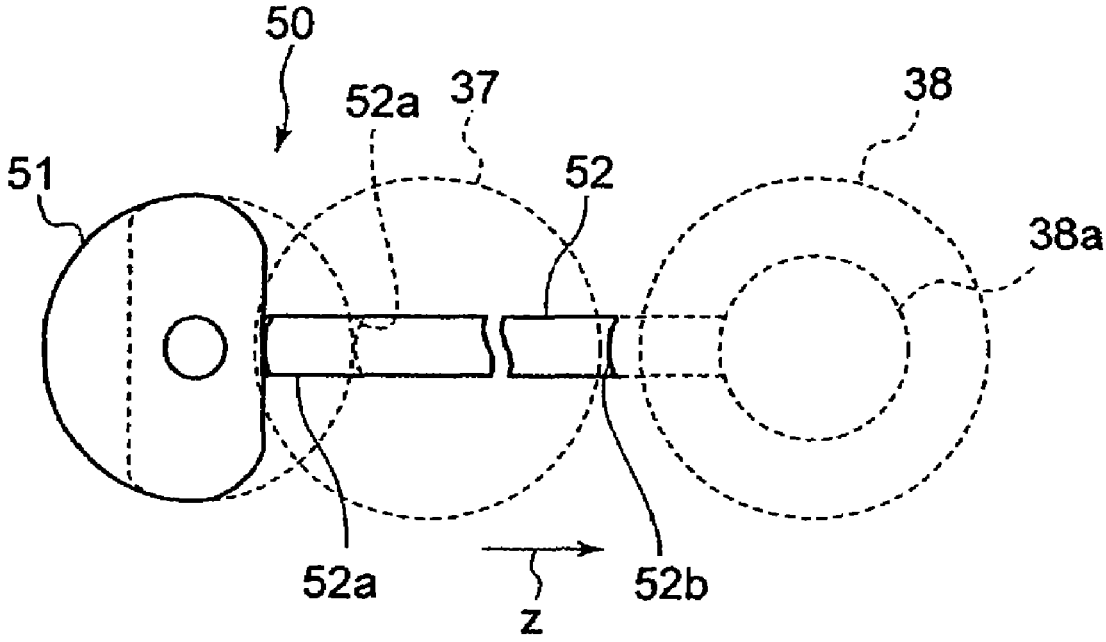
FIG. 9 is a schematic explanatory view showing a separation mechanism of the embodiment of the invention.

Next, in the color copier 1, an image forming process onto a thick paper P2 as a thick paper recording medium having, for example, a weighing capacity of 80 g/m.sup.2 or more will be described. When an image is formed on the thick paper P2, first, the mode of the color copier 1 is changed to a thick paper mode through the control panel of the color copier 1. By this, the first roller 37 and the second roller 38 of the registration roller pair 36 are separated from each other. The separation between the first roller 37 and the second roller 38 is performed by, for example, a separation mechanism 50 shown in FIG. 9 and provided at the front side and the rear side of the second roller 38. The separation mechanism 50 moves the second shaft 38*a* in the direction of separating from the first roller 37 by moving a plunger 52 in the arrow z direction.

That is, when the image forming process is changed to the thick paper mode, one end 52*a* of the plunger 52 is urged in the arrow z direction by the cam 51. The cam 51 is normally located at a position indicated by a solid line, and an urging force is not applied to the second shaft 38*a*. When the image forming process is changed to the thick paper mode, the cam 51 is rotated as indicated by a dotted line. By this, the plunger 52 moves in the arrow z direction, and an end 52*b* of the plunger gives the urging force in the arrow z direction to the second shaft 38*a*. As a result, the first roller 37 and the second roller 38 of the registration roller pair 36 are separated from each other.

As stated above, when the solenoid 48 is turned on while the first roller 37 and the second roller 38 are separate from each other, the cam 42*a* is slid in the arrow y1 direction at the front side, and is slid in the arrow y2 direction at the rear side by the extension of the plunger 48*a*. By this, the cam 42*a* is disposed at the adjustment position shown in FIG. 7 and FIG. 8. By this, the cam 42*a* is brought into slide contact with the first shaft 37*a*. Thereafter, the cam 51 is again rotated to the position indicated by the solid line, and the urging force to the second shaft 38*a* by the plunger 52 is released.

Next, the rotation of the registration roller pair 36 is started, and when the second shaft 38*a* is rotated, the cam 42*a* is rotated together with the second shaft 38*a* and is rotated in the arrow v direction. By this, the first roller 37 and the second roller 38 come in contact with each other. Incidentally, when the corner part 45*a* of the cam comes in contact with the stopper 43, the rotation of the cam 42*a* in the arrow v direction is regulated irrespective of the rotation together with the second shaft 38*a*.

In order to start the image forming process on the thick paper P2 in such a state, the thick paper P2 is fed from, for example, the manual feed tray 31*a*. The fed thick paper P2 synchronizes with the full-color toner image on the intermediate transfer belt 10, and the leading edge is aligned by the registration roller pair 36, and then, the thick paper is fed to the secondary transfer unit. At the time of feeding the thick paper P2, when the thick paper P2 is inserted into the registration roller pair 36, the pitch between the first roller 37 and the second roller 38, that is, the pitch between the first shaft 37*a* and the second shaft 38*a* is widened according to the thickness of the thick paper P2. By this, the cam 42*a* is urged by the cam spring 42*b*, and is rotated in the arrow w direction by the increase of the pitch between the first shaft 37*a* and the second shaft 38*a*.

While the thick paper P2 passes through the registration roller pair 36, the cam 42*a* is not rotated together with the second shaft 38*a* irrespective of the slide contact with the second shaft 38*a*. The posture of the cam 42*a* is controlled between the first shaft 37*a* and the second shaft 38*a* so as to hold the pitch widened by the thick paper P2. When the trailing edge of the thick paper P2 passes through the registration roller pair 36 and the force to widen the pitch between the first shaft 37*a* and the second shaft 38*a* is released, the cam 42*a* is rotated together with the slide-contacted second shaft 38*a* and is rotated in the arrow v direction. By this, the first roller 37 and the second roller 38 are brought into contact with each other. That is, when the trailing edge of the thick paper P2 passes through the registration roller pair 36, the first roller 37 and the second roller 38 are slowly returned to the contact state by the operation of the cam 42*a* rotated together with the second shaft 38*a*.

By the contact delay operation as stated above, although the thick paper P2 has high firmness, when the thick paper P2 passes through the resister roller pair 36, the trailing edge of the thick paper P2 is not flipped by the registration roller pair 36, and is not instantaneously accelerated. As a result, it is possible to prevent the image blur caused by the transfer blur in the secondary transfer unit when the thick paper P2 passes through the registration roller pair 36.

Thereafter, the thick paper P2 on which the toner image is transferred without causing the image blur is heated, pressed and fixed by the fixing device 30, and the fixed toner image is completed. Further, the thick paper P2 is discharged to the in-body paper discharge unit 3 by the paper discharge roller 41 through the gate 33, or is re-carried to the secondary transfer unit through the re-carrying unit 32. In the registration roller unit 35, until the image formation process to a specified number of thick papers P2 is ended in this way, the contact delay operation of the registration roller pair 36 by the pitch adjustment mechanism 42 is repeated.

After the image formation process onto the thick paper P2 is completed, next, the paper feed cassette 4 is selected by, for example, the control panel, and when it is recognized that the image formation process onto the standard paper P1 is to be performed, the color copier 1 is changed to the standard paper mode, and the solenoid 48 is turned off in the registration roller unit 35. By this, the cam 42*a* is pulled in the arrow x1 direction at the front side and is pulled in the arrow x2 direction at the rear side by the urging force of the movement spring 47, and is discharged from the adjustment position to the standby position, and the cam 42*a* is separated from the second shaft 38*a*. Thereafter, the image forming process to the standard paper P1 is started by the operation of a start button on the control panel.

In this standard paper mode, the pitch adjustment mechanism 42 at the standby position does not perform any operation on the registration roller pair 36. Besides, since the cam 42*a* of the registration roller pair 36 is separate from the second shaft 38*a*, it is not worn away by the slide contact with the second shaft 38*a*.

According to this embodiment, the pitch adjustment mechanism 42 can be moved between the adjustment position and the standby position, which prevents that, when the trailing edge of the sheet paper passes through the registration roller pair 36, the sheet paper is flipped by the registration roller pair 36 because of the motion in which the registration roller pair 36 returns to the contact state, and the image blur occurs. That is, when the sheet P is the standard paper P1, the solenoid 48 is turned off, and the pitch adjustment mechanism 42 is ejected from the adjustment position by the urging force of the movement spring 47 and is moved to the standby position. When the sheet P is the thick paper P2, the solenoid 48 is turned on, the plunger 48*a* is extended, and the pitch adjustment mechanism 42 is disposed at the adjustment position.

By this, at the time of the image forming process to the standard paper P1 in which there is no fear of occurrence of image blur when the paper passes through the registration roller pair 36, the cam 42*a* is separated from the second shaft 38*a*, and it is prevented that a specific portion of the cam 42*a* is worn away by the second shaft 38*a*. As a result, the rotation of the cam 42*a* by the urging force of the cam spring 42*b* can be smoothly performed, and the rotated operation of the cam 42*a* caused by the second shaft 38*a* can be smoothly performed. On the other hand, at the time of the image forming process to the thick paper P2, the contact delay operation between the first roller 37 and the second roller 38 after the thick paper P2 passes through can be performed by the operation of the pitch adjustment mechanism 42. As a result, it is possible to prevent the image blur from being caused when the thick paper P2 passes through the registration roller pair 36, and the image quality can be improved.

Incidentally, the invention is not limited to the above embodiment, and can be variously modified within the scope of the invention. For example, the carrying path for carrying the sheet paper through the registration roller pair may not be the vertical carrying path but may be the horizontal carrying path for carrying the sheet paper in the horizontal direction. Besides, the shape of the cam member of the contact delay mechanism and the attachment position of the first urging member are not limited. Further, when the contact delay mechanism is disposed at the adjustment position and when it is disposed at the standby position, the distribution of the urging force to the cam member by the first urging member is not limited. However, when the contact delay mechanism is at the standby position, the urging force of the first urging member is not originally required, and accordingly, it is preferable that the urging force of the first urging member is made smaller. Besides, the structure of the movement member or the timing of the movement of the contact delay mechanism by the movement member is not limited. Further, in this embodiment, although the change of the mode is performed by input from the control panel, when the medium sensor detects the thick paper, the change to the thick paper mode may be automatically performed.

What is claimed is:

1. A sheet carrying device for an image forming apparatus, comprising:

a registration roller pair to carry a recording medium to a transfer position of an image carrier;

a contact delay mechanism to set a pitch between the registration roller pair in accordance with a thickness of the recording medium passing through the registration roller pair and to hold the pitch when the recording medium passes through the registration roller pair; and a movement member to dispose the contact delay mechanism at an adjustment position at a time of carrying a thick paper recording medium and to eject the contact delay mechanism from the adjustment position by moving the contact delay mechanism in parallel to shafts of the registration roller pair at a time of carrying a standard paper recording medium.

2. The device according to claim 1, wherein the contact delay mechanism includes a cam member which is coaxial with one roller of the registration roller pair, and a cam part of which intervenes between the registration roller pair to come in slide contact with the other roller, and a first urging member to rotate the cam member in accordance with a pitch between shafts of the registration roller pair to be widened by the recording medium passing through the registration roller pair.

3. The device according to claim 2, wherein the movement member includes a solenoid to slide the cam member along the shaft of the one roller in a first direction, and a second urging member to urge the cam member in a second direction opposite to the first direction.

4. The device according to claim 3, wherein after the recording medium passes through the registration roller pair, the cam member returns to a default position by the slide contact of the cam part with the other roller.

5. The device according to claim 3, wherein an urging force of the first urging member when the contact delay mechanism is ejected from the adjustment position is smaller as compared with that when the contact delay mechanism is located at the adjustment position.

6. An image forming apparatus, comprising:

an image forming unit to form a toner image on an image carrier;

a registration roller pair to carry a recording medium to a transfer position of the image carrier;

a contact delay mechanism to set a pitch between the registration roller pair in accordance with a thickness of the recording medium passing through the registration roller pair; and a movement member to dispose the contact delay mechanism at an adjustment position at a time of carrying a thick paper recording medium and to eject the contact delay mechanism from the adjustment position by moving the contact delay mechanism in parallel to shafts of the registration roller pair at a time of carrying a standard paper recording medium.

7. The apparatus according to claim 6, wherein the contact delay mechanism includes a cam member which is coaxial with one roller of the registration roller pair, a cam part of which intervenes between the registration roller pair to come in slide contact with the other roller, and which returns to a default position by the slide contact of the cam part with the other roller after the recording medium passes through the registration roller pair, and a first urging member to rotate the cam member in accordance with a pitch between shafts of the registration roller pair to be widened by the recording medium passing through the registration roller pair.

8. The apparatus according to claim 7, wherein the movement member includes a solenoid to slide the cam member along the shaft of the one roller in a first direction, and a second urging member to urge the cam member in a second direction opposite to the first direction.

9. The apparatus according to claim 7, wherein an urging force of the first urging member when the contact delay mechanism is ejected from the adjustment position is smaller as compared with that when the contact delay mechanism is located at the adjustment position.

10. A sheet carrying method for an image forming apparatus, comprising:

providing a contact delay mechanism to be capable of being disposed at an adjustment position of a registration roller pair, which sets a pitch between the registration roller pair in accordance with a thickness of a recording medium and holds the pitch when the recording medium passes through the registration roller pair;

ejecting the contact delay mechanism from the adjustment position when the registration roller pair carries a standard paper recording medium; and disposing the contact delay mechanism at the adjustment position by moving the contact delay mechanism in parallel to shafts of the registration roller pair when the registration roller pair carries a thick paper recording medium.

11. The method according to claim 10, wherein a cam member of the contact delay mechanism, which is coaxial with one roller of the registration roller pair, is rotated by a first urging member to be fitted in a pitch between shafts of the registration roller pair to be widened at a time of carrying the thick paper recording medium.

12. The method according to claim 11, wherein after the thick paper recording medium passes through the registration roller pair, the cam member returns to a default position by slide contact with the other roller of the registration roller pair.

13. The method according to claim 12, wherein an urging force of the first urging member when the contact delay mechanism is ejected from the adjustment position is smaller as compared with that when the contact delay mechanism is located at the adjustment position.

* * * * *